United States Patent [19]

Ford et al.

[11] Patent Number: 4,930,703

[45] Date of Patent: Jun. 5, 1990

[54] INTEGRAL FUEL NOZZLE COVER FOR GAS TURBINE COMBUSTOR

[75] Inventors: John E. Ford, Schenectady; Albert Myers, Amsterdam, both of N.Y.

[73] Assignee: General Electric Company

[21] Appl. No.: 288,393

[22] Filed: Dec. 22, 1988

[51] Int. Cl.[5] ..... F23L 1/00; B05B 7/06

[52] U.S. Cl. ..... 239/424; 239/428; 239/548

[58] Field of Search ..... 239/417, 423, 424, 425, 239/550, 551, 548

[56] References Cited

U.S. PATENT DOCUMENTS

| | | | |
|---|---|---|---|
| 233,397 | 10/1880 | Bradley | 239/413 X |
| 622,482 | 2/1899 | Jackson | 239/424 X |
| 878,461 | 2/1908 | Harris | 239/424 X |
| 1,741,532 | 12/1929 | Morse | 239/428 X |
| 4,797,087 | 1/1989 | Gitman | 239/423 X |

*Primary Examiner*—Andres Kashnikow
*Assistant Examiner*—Kevin P. Weldon
*Attorney, Agent, or Firm*—Robert Lampe

[57] ABSTRACT

A nozzle cover for a combustor of a combination fuel gas turbine engine is cast as a one-piece integral part requiring machining only for holes, sealing surfaces and threads. The nozzle cover cross section is generally a portion of an ellipsoid in order to maximize strength for a given amount of material. An interface between the nozzle cover and each of a plurality of combination fuel nozzles employs a single threaded opening accommodating two of a required three nozzles. The third nozzle in each combination fuel nozzle is accommodated in threads formed in a stepped wall in the nozzle cover.

10 Claims, 3 Drawing Sheets

PRIOR ART
FIG. 3
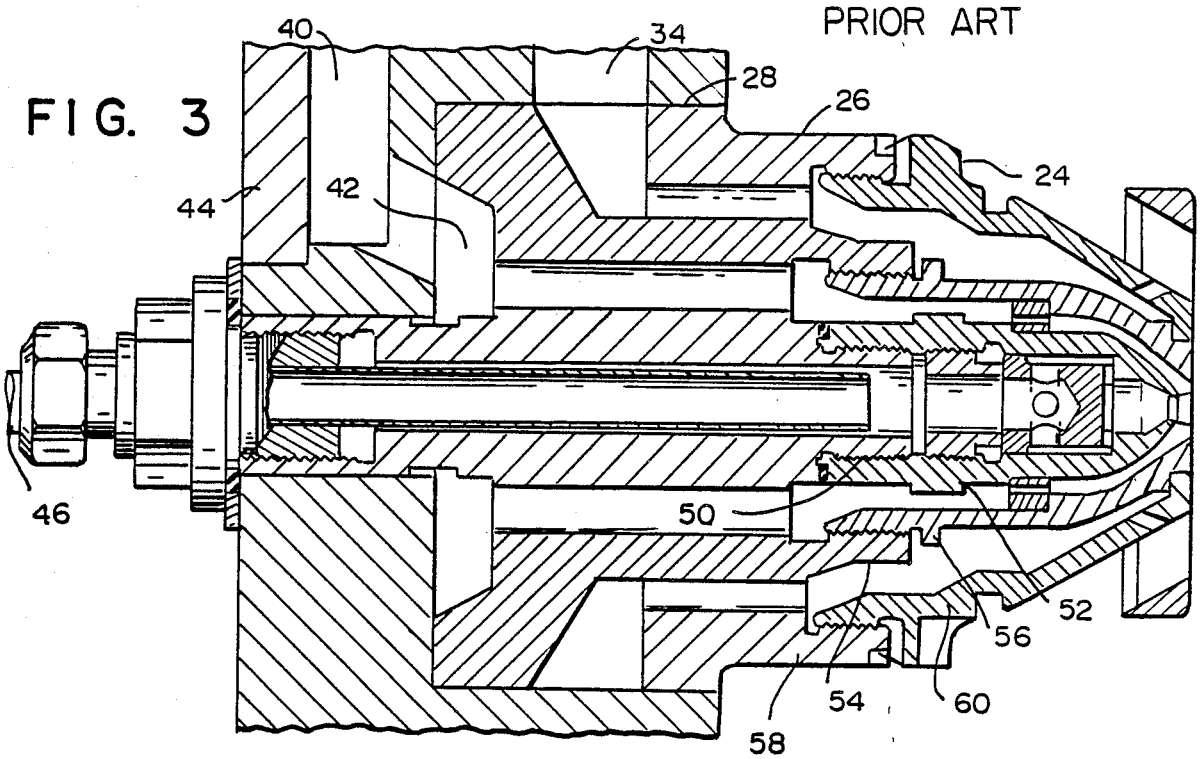
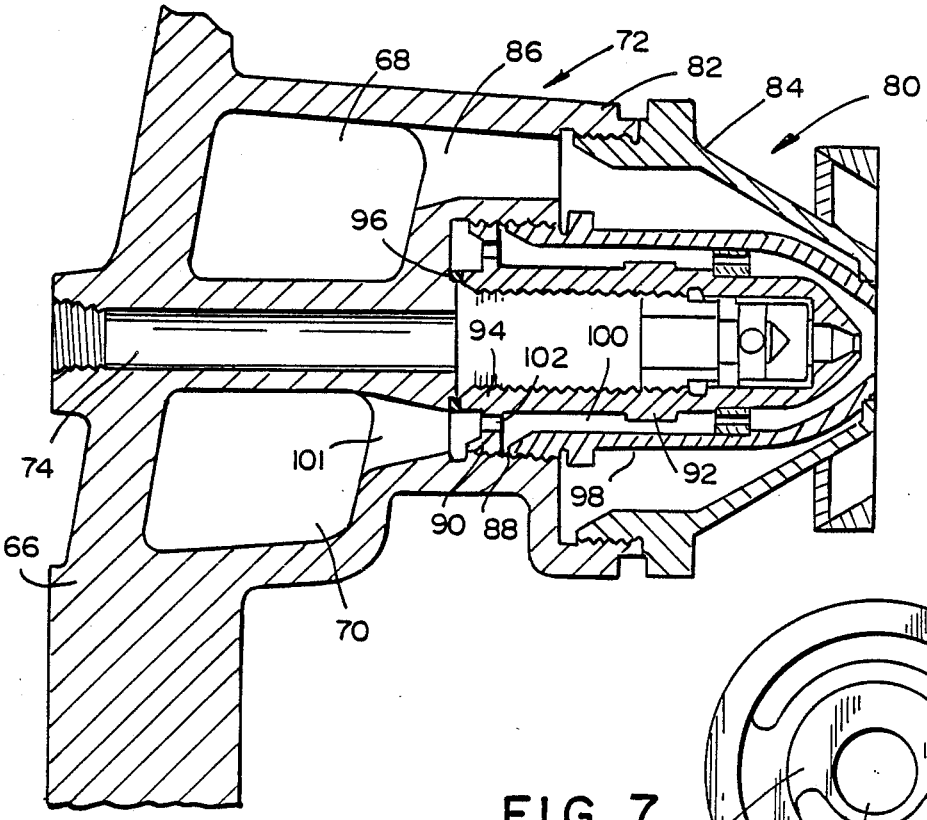
FIG. 6
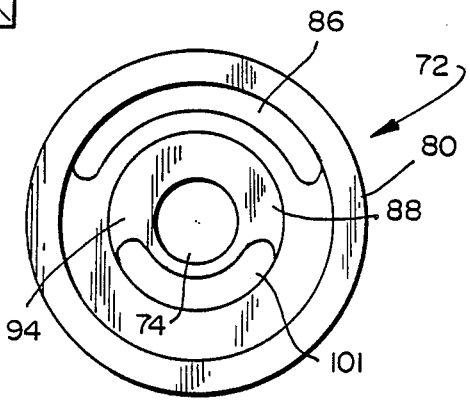
FIG. 7

INTEGRAL FUEL NOZZLE COVER FOR GAS TURBINE COMBUSTOR

BACKGROUND OF THE INVENTION

The present invention relates to combustors for gas turbine engines and, more particularly, to nozzle covers and combustion nozzles useful in combustors of gas turbine engines.

A large gas turbine engine may include a plurality of combustors arranged in a circle about other elements of the engine. Fuel and air are admitted into each combustor to produce a fuel-air mixture.

One type of combustor, of interest to the present invention, employs a combination of fuels such as, for example, two different gasses or a gas and an air-atomized liquid, fed to each nozzle. Such a combustor typically burns gas fuel during normal operation. Alternatively, a liquid fuel, atomized by a vigorous swirling supply of air, emitted from the nozzle, may be burned. Combinations of either or both fuels in varying proportions may be burned.

A nozzle cover, forming the upstream end of the combustor, includes manifolds therein for conveying fuel gas and air to the locations of all of the several nozzles in that nozzle cover. The nozzles are installed in the nozzle cover to mate air and fuel-gas passages in the nozzles with corresponding manifolds in the nozzle cover. Liquid fuel is connected directly to each appropriate nozzle.

A nozzle cover is conventionally fabricated by machining, welding and brazing together individual elements to form the required manifolds. Threaded annular walls are provided in a special insert for installation of the nozzles and for the interfacing with the supply of liquid fuel and the fuel gas and air in the manifolds. In one design, the nozzle cover is formed of seventeen separate brazed or welded parts.

A nozzle cover of a combustor is a large object measuring, for example, about 22 to 27 inches across. The limitations of brazing require substantial precision, so that abutting surfaces to be brazed are close enough together to permit brazing to be performed successfully.

The prior art insert includes three coaxial, coplanar, annular walls to which the nozzle parts are affixed by threads. The conventional design leaves little room for insertion of tools for forming the required threads on the annular walls.

OBJECTS AND SUMMARY OF THE INVENTION

It is an object of the invention to provide a nozzle cover which overcomes the drawbacks of the prior art.

It is a further object of the invention to provide a nozzle cover and nozzle assembly capable of being manufactured at lower cost.

It is a further object of the invention to provide a cast nozzle cover having integrally formed manifolds mating with chambers in nozzles installed therein.

It is a further object of the invention to provide a nozzle cover having an optimum shape.

It is a still further object of the invention to provide a nozzle cover having reduced weight compared to brazed and welded nozzle covers of the prior art.

Briefly stated, the present invention provides a nozzle cover for a combustor of a combination fuel gas turbine engine which is cast as a one-piece integral part requiring machining only for holes, sealing surfaces and threads. The nozzle cover cross section is generally a portion of an ellipsoid in order to maximize strength for a given amount of material. An interface between the nozzle cover and each of a plurality of combination fuel nozzles employs a single threaded opening accommodating two of a required three nozzles. The third nozzle in each combination fuel nozzle is accommodated in threads formed in a stepped wall in the nozzle cover.

According to an embodiment of the invention, there is provided a nozzle cover for a gas turbine combustor comprising: a one-piece integral part, the one-piece integral part including at least first and second manifolds integrally formed therein, first means for entering a first gas to the first manifold, second means for entering a second gas to the second manifold, at least one nozzle holder integrally formed in the nozzle cover, the nozzle holder including first means for interfacing with a first manifold, the nozzle holder further including means for accepting a first nozzle, the nozzle holder including means for feeding the first gas to the first nozzle, the nozzle holder including second means for interfacing with the second manifold, the nozzle holder further including means for accepting a second nozzle, the second nozzle being coaxial with the first nozzle, and the nozzle holder including means for feeding the second gas to the second nozzle.

According to a feature of the invention, there is provided a nozzle cover for a combustor of a gas turbine engine comprising: a one-piece integral part, the one-piece integral part including at least first and second manifolds, at least one nozzle holder in the one-piece integral part, the first and second manifolds including means for supplying first and second gasses to the nozzle holder, and the nozzle cover having a generally concave shape as seen from inside the combustor.

According to a further feature of the invention, there is provided a nozzle holder and nozzle in a nozzle cover of a gas turbine engine, the nozzle cover including first and second manifolds for conveying a gas fuel and a second gas to the nozzle holder, comprising: an outer annular wall, the outer annular wall including first threads in a surface thereof, a first nozzle for the gas fuel, second threads on the first nozzle threadably engageable with the first thread, a cylindrical depression centered in the outer annular wall, third threads in the cylindrical depression, a liquid-fuel nozzle, the liquid-fuel nozzle including fourth threads engageable with the third threads for retaining the liquid-fuel nozzle centered within the first nozzle, a second gas nozzle, the second gas nozzle including fifth threads engageable with the third threads for retaining the second gas nozzle centered over the liquid-fuel nozzle and within the first nozzle, the fourth and fifth threads being disposed in an axial sequence on the third threads, the fourth threads being engaged with the third threads further in the cylindrical depression than the fifth threads, and means for permitting a second gas from the first manifold to flow past the fourth threads, whereby the second gas is enabled to reach the second gas nozzle.

According to a still further feature of the invention, there is provided a method for making a nozzle cover for a gas turbine engine comprising: forming a replica of the nozzle cover in a material, the replica including at one nozzle holder and at least first and second manifolds, the first and second manifolds communicating with the at least one nozzle holder, the replica being capable of melting at a melting temperature, covering the replica with an investment compound, raising the investment compound, containing the replica, to a temperature exceeding the melting temperature, whereby the material is lost from the investment compound, and a female copy of the replica is formed in the investment compound, and casting a metal in the female copy, whereby a male copy of the replica, including the at least first and second manifolds and the at least one nozzle holder, is formed as an integral unit.

According to a still further feature of the invention, there is provided a method for making a nozzle cover for a gas turbine engine comprising: forming a replica of the nozzle cover in a material, the replica including at one nozzle holder and at least first and second manifolds, the first and second manifolds communicating with the at least one nozzle holder, covering the replica with a casting material, whereby a negative replica of the model is formed in the casting material, removing the replica from the casting material to leave a female copy of the replica in the casting material, and casting a metal in the female copy, whereby a male copy of the replica, including the at least first and second manifolds and the at least one nozzle holder, is formed as an integral unit.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 3 is an enlarged cross section of a nozzle retaining insert and a combination fuel nozzle mated therewith according to the prior art.

FIG. 6 is an enlarged cross section of FIG. 5 in the vicinity of the combination fuel nozzle, with the combination fuel nozzle installed.

FIG. 7 is a view taken in the direction VII—VII in FIG. 5.

DETAILED DESCRIPTION OF THE PREFERRED EMBODIMENT

Figure 1:
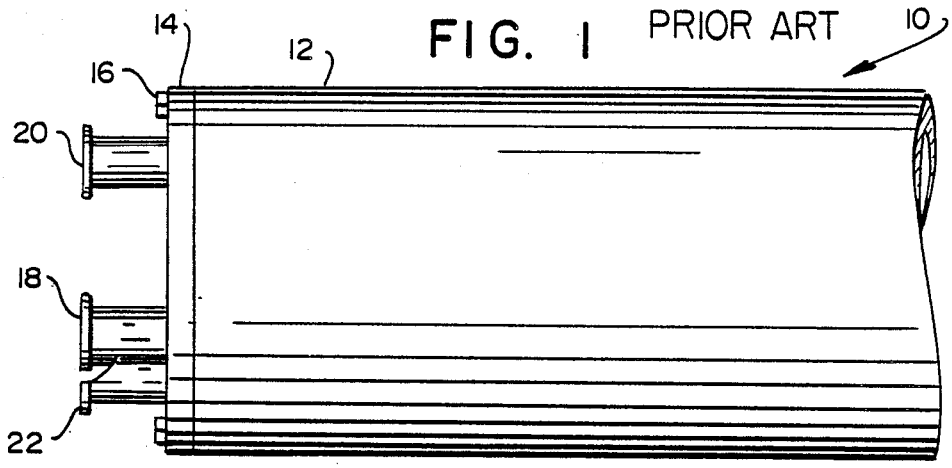
FIG. 1 PRIOR ART
FIG. 1 is a side view of a portion of a combustor to which reference will be made in describing the prior art and the present invention.

Referring to FIG. 1, there is shown, generally at 10, a portion of a combustor according to the prior art. A combustor housing 12 has one end closed by a generally disk-shaped nozzle cover 14. Fuel nozzle cover 14 is retained in place by conventional means such as a ring of bolts 16 (only two of which are shown). Three connectors are affixed to nozzle cover 14, namely, a gas fuel connector 18, an air connector 20, and a liquid fuel connector 22, each for connection of its respective material to nozzles (not shown) within combustor 10.

In a complete gas turbine engine, combustor housing 12 is connected to a plenum (not shown) to which a supply of pressurized air is connected. The pressurized air is permitted to pass through combustor housing 12 by well-known means from the plenum (not shown) to the interior of combustor housing 12 for cooling and for supporting combustion therein. Since the elements external to combustor housing 12 are well known to those skilled in the art, and since the inventive contribution of the present disclosure is elsewhere, further recitation thereof is considered unnecessary to enable one skilled in the art to make and use the present invention.

Figure 2:
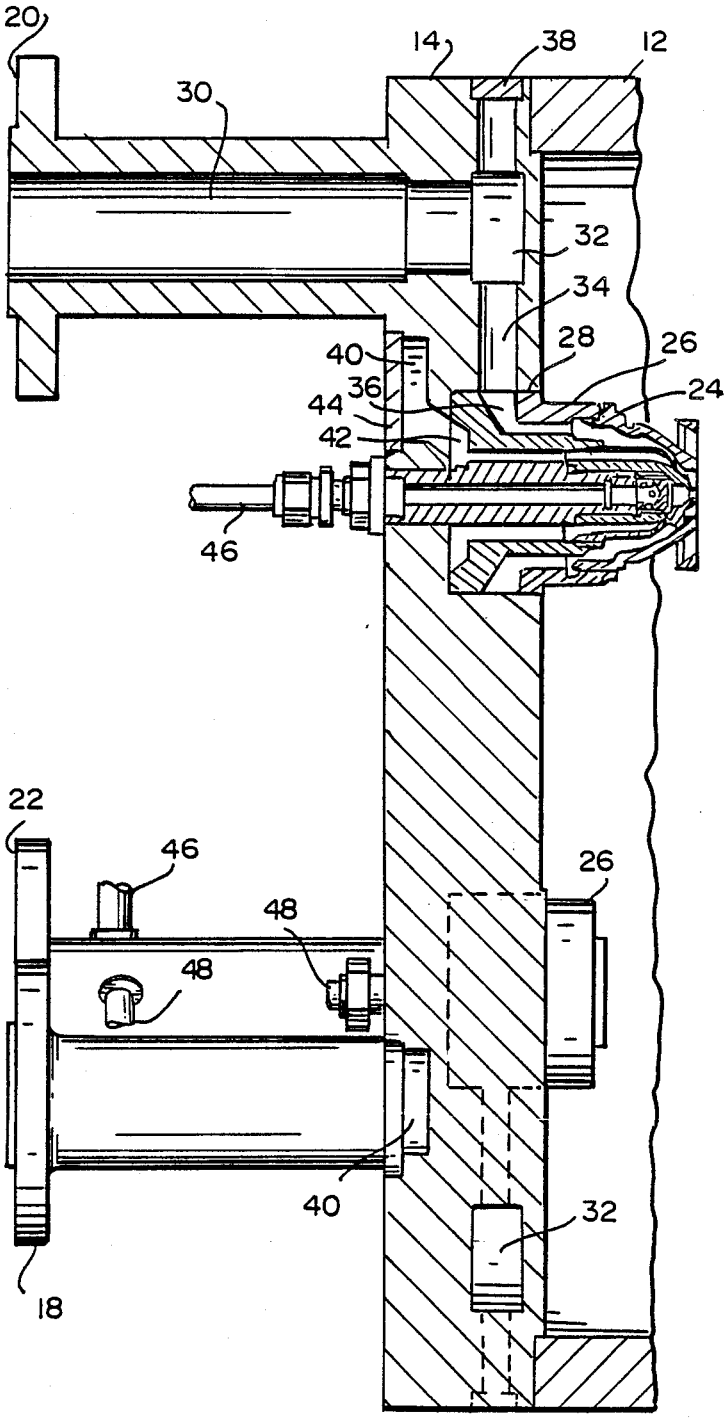
PRIOR ART FIG. 2
FIG. 2 is a cross section through the nozzle cover of a prior art embodiment of the combustor of FIG. 1.

Referring now to FIG. 2, a cross section of a portion of nozzle cover 14 reveals that a combination fuel nozzle 24, conventionally one of several, is installed in an insert 26 permanently affixed in an opening 28 in nozzle cover 14. Gas connector 20 includes a gas conduit 30 leading to a gas manifold 32 which passes about nozzle cover 14. A gas channel 34 connects gas from gas manifold 32 to a gas passage 36 in insert 26. Gas channel 34 is conventionally formed by boring from an exterior of nozzle cover 14, as shown, and sealing the bore with a sealing plug 38.

Air connector 18 is connected to an air manifold 40 that leads to an air chamber 42 in each insert 26. Access to air manifold 40 is sealed by a cap 44 which may be installed in any convenient manner such as, for example, by brazing or welding.

Liquid fuel connector 22 includes a plurality of liquid fuel distribution tube 46-48, one leading to each insert 26. For example, liquid fuel distribution tube 46, as illustrated, leads to insert 26 shown in cross section. Liquid fuel distribution tube 48 leads to a further insert 26, which is illustrated with its combination fuel nozzle 24 removed.

Referring now to the enlarged view of the vicinity of combination fuel nozzle 24 in FIG. 3, an exterior of an inner annular wall 50 on insert 26 is threaded to receive matching threads on an interior of a liquid fuel nozzle 52. An interior of an intermediate annular wall 54 insert 26 is threaded to receive matching threads on an exterior of a air nozzle 56. Similarly, an interior of an outer annular wall 58 of insert 26 is threaded to receive matching threads on an exterior of a gas fuel nozzle 60.

The remainder of combination fuel nozzle 24 is conventional, and is not further discussed.

It will be noted that inner annular wall 50, intermediate annular wall 54 and outer annular wall 58 are concentric to each other, and lie at about the same axial positions. It has been found that the annular space between inner annular wall 50 and intermediate annular wall 54 makes it difficult to insert a machine tool for machining the internal threads on outer annular wall 58. Similarly, the annular space between inner annular wall 50 and intermediate annular wall 54 makes it difficult to insert a machine tool for machining the external and internal threads thereon. Finally, it will be noted that insert 26 requires relatively complex machining to provide appropriate mating with the incoming supplies of air, gas fuel and liquid fuel.

Figure 4:
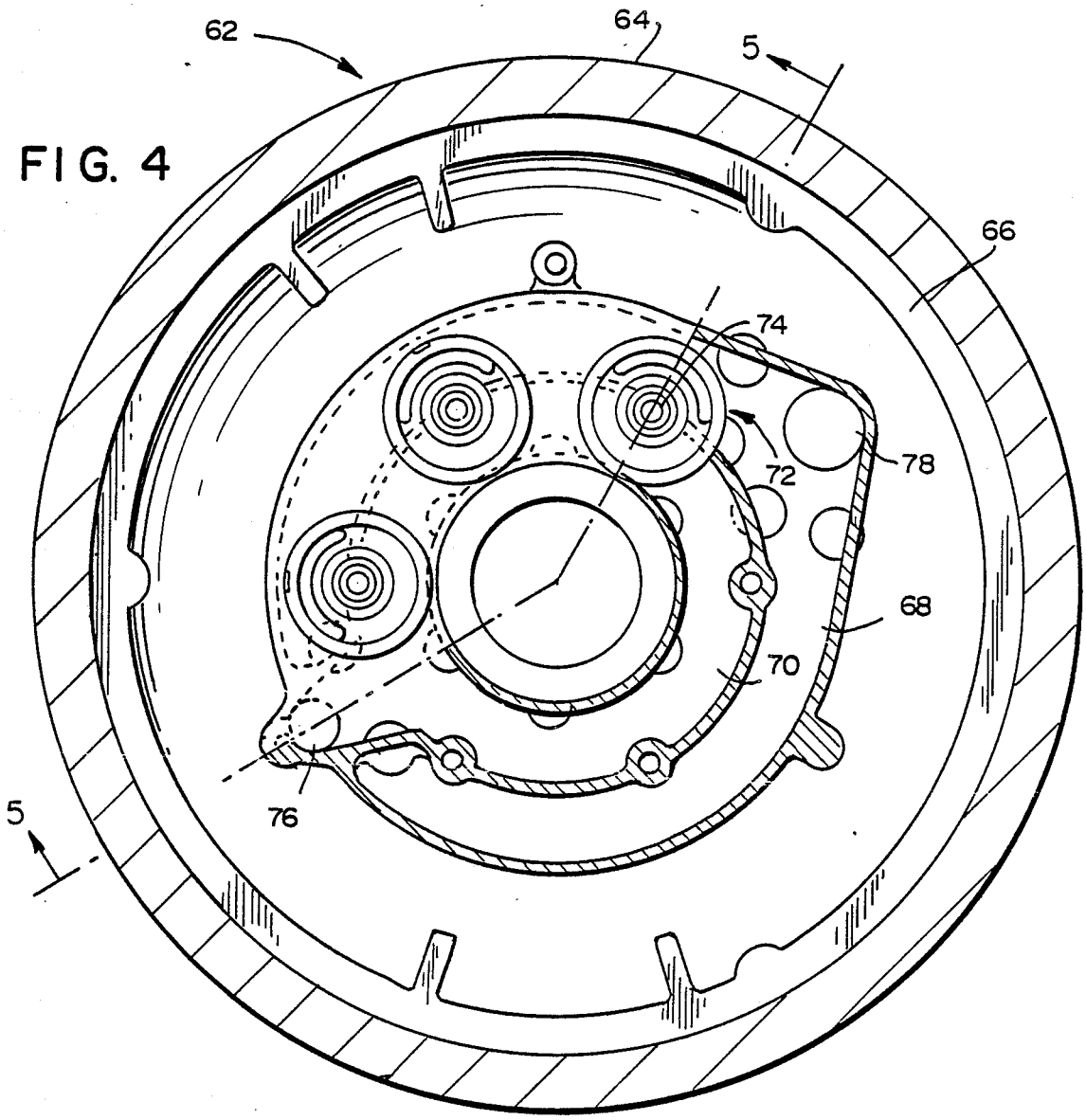
FIG. 4 is a cross section of a combustor taken along IV—IV in FIG. 5.
Figure 5:
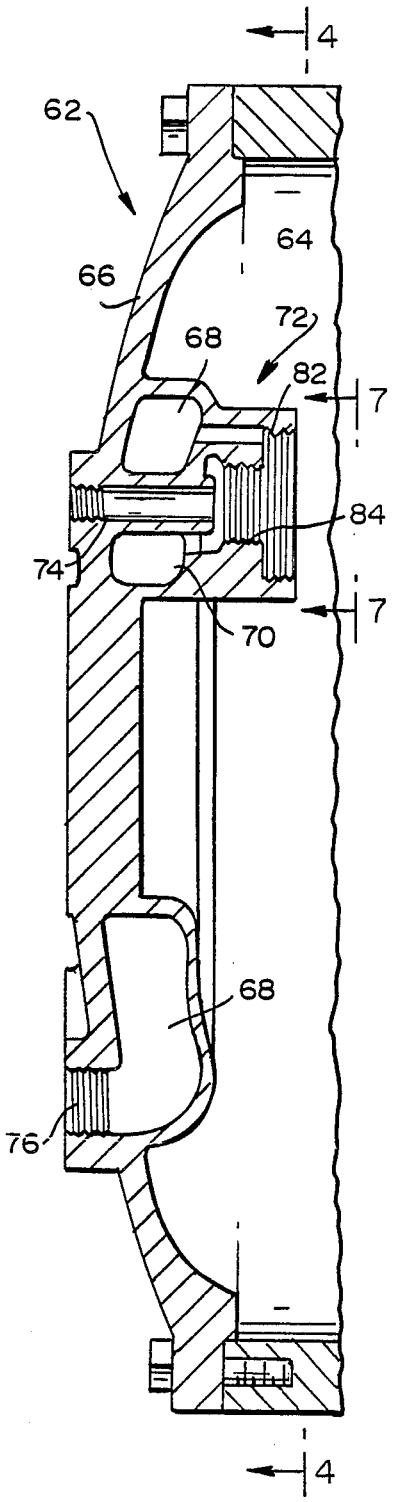
FIG. 5 is a cross section of a combustor taken along V—V in FIG. 4, with the combination fuel nozzle removed.

FIGS. 4 and 5, to which reference is now made, are related in that FIG. 4 is a cross section taken along IV—IV in FIG. 5 and FIG. 5 is a cross section taken along V—V in FIG. 4. A portion of a combustor 62 includes a combustor housing 64, to which is affixed a one-piece nozzle cover 66.

One-piece nozzle cover 66 is preferably fabricated by investment casting, whereby all shapes required are produced at the same time. Investment casting, sometimes called the lost wax process, is a common technique for casting metal and other materials. Briefly, a wax model of the object to be cast is formed in any convenient way such as, for example, by sculpting or molding. The wax model is covered by an investment compound which becomes hardened. The investment compound, and the wax model within it, are heated so that the wax melts and flows away, leaving an accurate female mold into which metal, or other molten material, is poured.

The use of investment casting to form one-piece nozzle cover 66 provides advantages in shape, savings in material, and savings in cost. As best seen in FIG. 5, one-piece nozzle cover 66 has a shape generally approximating a portion of an ellipsoid. This provides the maximum strength for a given amount of material. Thus, less material is required for a given strength of one-piece nozzle cover 66 than would be required if one-piece nozzle cover 66 were formed as a planar disk. In addition a gas fuel manifold 68 and an air manifold 70 are integrally formed during the investment casting process. A liquid fuel channel 74 is formed centered in each nozzle holder 72. Also, nozzle holders 72, as well as their interfaces with gas fuel manifold 68 and air manifold 70 are integrally formed when the part is cast. In addition, an air connection 76 is formed in communication with air manifold 70, and a gas fuel connection 78 is formed in communication with gas fuel manifold 68. Except for machining of sealing surfaces and holes and threading operations, one-piece nozzle cover 66 is used as cast, without requiring further finishing operations.

Notwithstanding the close tolerances that are attainable using investment casting, the use of other casting methods should not be considered to depart from the spirit of the invention, taken in its broadest sense. For example, sand casting may be used. In sand casting, a positive model of the device to be cast is half buried in a lower frame containing a special casting sand. An upper frame is placed about the upper half of the model, and filled with the casting sand. This forms the shape of the model in the sand in the upper and lower frames. Then, the upper frame is removed, and the positive model is removed from the casting sand. The upper frame is restored atop the lower frame, and metal is poured into the cavity to form the desired piece.

One-piece nozzle cover 66 may be used with combination fuel nozzles 24 of the prior art. Referring now to FIG. 6, one-piece nozzle cover 66 preferably is used with an improved combination fuel nozzle 80 according to the present invention. A outer annular wall 82 includes internal threads thereon for mating with outer threads on a gas fuel nozzle 84. A gas passage 86 communicates gas fuel from gas fuel manifold 68 to the interior of gas fuel nozzle 84.

A cylindrical depression 88, centered about liquid fuel channel 74, includes threads along substantially the entire length of its inner surface. An outward directed flange 90 on a liquid fuel nozzle 92 includes threads on its outer surface for mating with the threads on the inner surface of cylindrical depression 88. Liquid fuel nozzle 92 is sealed to a sealing surface 94 at the base of cylindrical depression 88 by any convenient means such as, for example, a seal 96. Such sealing provides liquid-tight communication between liquid fuel channel 74 and liquid fuel nozzle 92 for delivery of liquid fuel to downstream elements in liquid fuel nozzle 92.

The downstream elements in liquid fuel nozzle 92 are all conventional and well known to those skilled in the art. Thus, these elements are not described further herein.

It will be noted that outward directed flange 90 occupies only the innermost portion of cylindrical depression 88. This leaves space for installation of an air nozzle 98 on the same threads in cylindrical depression 88. The inner surface of air nozzle 98 and the outer surface of liquid fuel nozzle 92 define an air flow chamber 100. An air passage 101 communicates between air manifold 70 and combination fuel nozzle 80. A plurality of air openings 102 in outward directed flange 90 permit air to pass therethrough from air passage 101 to air flow chamber 100. The elements downstream of air flow chamber 100 are conventional, and are thus not further described.

The arrangement of combination fuel nozzle 80 and nozzle holder 72 solves the problems of machining threads in restricted spaces which is experienced with the prior-art combination fuel nozzle. The stepped design of outer annular wall 82 and cylindrical depression 88 permits large access space to the surfaces thereof for machining the required threads. This is particularly abetted by the double use of threads on cylindrical depression 88 to retain both sealing surface 94 and air nozzle 98. Also, the recess produced by cylindrical depression 88 permits use of the entire diameter within outer annular wall 82 for manipulation of tools for the formation of threads thereon.

Referring now to FIG. 7, a front view of nozzle holder 72 reveals that air passage 101 has a generally lunate shape occupying less than 180 degrees. In addition, gas passage 86 has a generally lunate shape and is disposed in a location opposed to air passage 101.

The nozzle covers and combination nozzles described in the preceding have been directed to the use of a fuel gas, a liquid fuel and air. The air is used principally for atomization and mixing of the liquid fuel. One skilled in the art would recognize that a second gas could be substituted for air to perform at least some of the functions for which air is used. An inert gas such as, for example, nitrogen, or an active gas such as, for example, oxygen, could be substituted for air in any of the foregoing embodiments without departing from the spirit and scope of the present invention.

In addition, it is within the contemplation of the invention to employ the nozzle cover and nozzles of the present invention to supply two different fuel gasses to the combustor. This may be valuable when a low-BTU and a high-BTU gas are available. With the present invention, the low- and high-BTU gasses may be supplied to the nozzles alternately, or in any combination.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A nozzle cover for a gas turbine combustor comprising:

a one-piece integral part;

said one-piece integral part including at least first and second manifolds integrally formed therein;

first means for entering a first gas to said first manifold;

second means for entering a second gas to said second manifold;

at least one nozzle holder integrally formed in said nozzle cover;

said nozzle holder including first means for interfacing with said first manifold;

said nozzle holder further including means for accepting a first nozzle;

said nozzle holder including means for feeding said first gas to said first nozzle;

said nozzle holder including second means for interfacing with said second manifold;

said nozzle holder further including means for accepting a second nozzle;

said second nozzle being coaxial with said first nozzle; and said nozzle holder including means for feeding said second gas to said second nozzle.

2. A nozzle cover according to claim 1, further comprising:

said nozzle holder further including means for accepting a third nozzle;

said third nozzle being coaxial with said first and second nozzles; and means for feeding a liquid fuel to said third nozzle.

3. A nozzle cover according to claim 2, wherein said first gas is air and said second gas is a gas fuel.

4. A nozzle cover according to claim 1, wherein said first gas is air and said second gas is a gas fuel.

5. A nozzle cover for a gas turbine combustor comprising:

a one-piece integral part;

said one-piece integral part including at least first and second manifolds integrally formed therein;

first means for entering a first gas to said first manifold;

second means for entering a second gas to said second manifold;

at least one nozzle holder integrally formed in said nozzle cover;

said nozzle holder including first means for interfacing with said first manifold;

said nozzle holder further including means for accepting a first nozzle;

said nozzle holder including means for feeding said first gas to said first nozzle;

said nozzle holder including second means for interfacing with said second manifold;

said nozzle holder further including means for accepting a second nozzle;

said second nozzle being coaxial with said first nozzle and said nozzle holder including means for feeding said second gas to said second nozzle wherein said nozzle cover includes a generally elliptical transverse cross-section.

6. A nozzle cover for a combustor of a gas turbine engine comprising:

a one-piece integral part;

said one-piece integral part including at least first and second manifolds;

at least one nozzle holder in said one-piece integral part;

said first and second manifolds including means for supplying first and second gasses to said nozzle holder; and said nozzle cover having a generally concave shape as seen from inside said combustor.

7. A nozzle holder and nozzle in a nozzle cover of a gas turbine engine, said nozzle cover including first and second manifolds for conveying a gas fuel and a second gas to said nozzle holder, comprising:

an upper annular wall;

said outer annular wall including first threads in a surface thereof;

a first nozzle for said gas fuel;

second threads on said first nozzle threadably engageable with said first thread;

a cylindrical depression coaxial with said outer annular wall;

third threads in said cylindrical depression:

a liquid-fuel nozzle;

said liquid-fuel nozzle including fourth threads engageable with said third threads for retaining said liquid-fuel nozzle centered within said first nozzle;

a second gas nozzle;

said second gas nozzle including fifth threads engageable with said third threads for retaining said second gas nozzle centered over said liquid-fuel nozzle and within said first nozzle;

said fourth and fifth threads being disposed in an axial sequence on said third threads;

said fourth threads being engaged with said third threads further in said cylindrical depression than said fifth threads; and means for permitting a second gas from said first manifold to flow past said fourth threads, whereby second gas is enabled to reach said second gas nozzle.

8. A method for making a nozzle cover for a gas turbine engine comprising:

forming a replica of said nozzle cover in a material;

said replica including at least one nozzle holder and at least first and second manifolds;

said first and second manifolds communicating with said at least one nozzle holder;

said replica being capable of melting at a melting temperature;

covering said replica with an investment compound;

raising said investment compound, containing said replica, to a temperature exceeding said melting temperature, whereby said material is lost from said investment compound, and a female copy of said replica is formed in said investment compound; and casting a metal in said female copy, whereby a male copy of said replica, including said at least first and second manifolds and said at least one nozzle holder, is formed as an integral unit.

9. A nozzle cover for a gas turbine combustor comprising:

a one-piece integral part;

said one-piece integral part including at least first and second manifolds integrally formed therein;

first means for entering a first gas to said first manifold;

second means for entering a second gas to said second manifold;

at least one nozzle holder integrally formed in said nozzle cover;

said nozzle holder including first means for interfacing with said first manifold;

said nozzle holder further including means for accepting a first nozzle;

said nozzle holder including means for feeding said first gas to said first nozzle;

said nozzle holder including second means for interfacing with said second manifold;

said nozzle holder further including means for accepting a second nozzle;

said second nozzle being coaxial with said first nozzle;

said nozzle holder including means for feeding said second gas to said second nozzle;

said first gas is a first gas fuel; and said second gas is a second gas fuel.

10. A method for making a nozzle cover for a gas turbine engine comprising:

forming a replica of said nozzle cover in a material;

said replica including at least one nozzle holder and at least first and second manifolds;

said first and second manifolds communicating with said at least one nozzle holder;

covering said replica with a casting material, whereby a negative replica of said model is formed in said casting material;

removing said replica from said casting material to leave a female copy of said replica in said casting material; and casting a metal in said female copy, whereby a male copy of said replica, including said at least first and second manifolds and said at least one nozzle holder, is formed as an integral unit.

* * * * *